US009662539B2

(12) United States Patent
Rakhmatullin et al.

(10) Patent No.: US 9,662,539 B2
(45) Date of Patent: May 30, 2017

(54) THERAPEUTIC EXERCISE METHOD AND THERAPEUTIC EXERCISE APPARATUS

(71) Applicants: Ildar Farvazovich Rakhmatullin, Tyumen (RU); Sergei Andreevich Kuzevanov, Tyumen (RU)

(72) Inventors: Ildar Farvazovich Rakhmatullin, Tyumen (RU); Sergei Andreevich Kuzevanov, Tyumen (RU)

(73) Assignee: Krisaf LLC, Tyumen (RU)

( * ) Notice: Subject to any disclaimer, the term of this patent is extended or adjusted under 35 U.S.C. 154(b) by 343 days.

(21) Appl. No.: 14/366,086

(22) PCT Filed: Oct. 15, 2012

(86) PCT No.: PCT/RU2012/000831

§ 371 (c)(1),
(2) Date: Jun. 17, 2014

(87) PCT Pub. No.: WO2013/105874

PCT Pub. Date: Jul. 18, 2013

(65) Prior Publication Data

US 2014/0342877 A1 Nov. 20, 2014

(30) Foreign Application Priority Data

Jan. 10, 2012 (RU) ..... 2012100086

(51) Int. Cl.
*A61H 11/00* (2006.01)
*A63B 24/00* (2006.01)
(Continued)

(52) U.S. Cl.
CPC ..... *A63B 24/0087* (2013.01); *A61H 1/001* (2013.01); *A61H 1/0229* (2013.01);
(Continued)

(58) Field of Classification Search
CPC . A61H 1/00; A61H 1/001; A61H 1/02; A61H 2001/0203; A61H 1/0218;
(Continued)

(56) References Cited

U.S. PATENT DOCUMENTS 5,667,461 A * 9/1997 Hall ..... A61H 1/0229 472/15
2003/0153438 A1* 8/2003 Gordon ..... A63B 22/02 482/92

(Continued)

FOREIGN PATENT DOCUMENTS

CN 201320275 10/2009
EP 2067462 6/2009

(Continued)

*Primary Examiner* — Steven Douglas
(74) *Attorney, Agent, or Firm* — Aleksandr Smushkovich

(57) ABSTRACT

The proposed apparatus and method relate to restorative sports medicine and patient rehabilitation with neurological motoric disorders. A patient is positioned in equilibrium by suspension devices for patient's body parts. The suspension devices are moved by actuating mechanisms with an electro-pneumatic drive and actuating components, controlled by a programmed computer, motivating the patient by controlling an object in a virtual gaming environment, to restore movements when there is an initially minimal or a complete absence of physical activity. The effectiveness is judged according to the reduction of energy consumption of the drives. The apparatus includes a base composed of two parallel guides with movable crossbars, on which the actuating mechanisms are pairwise movably arranged, monitoring and control units, the computer, sensors detecting the state of the actuating mechanisms, and power sources. There are units for analyzing the energy consumption of each drive and for assessing the treatment results.

4 Claims, 5 Drawing Sheets

Figure 1:
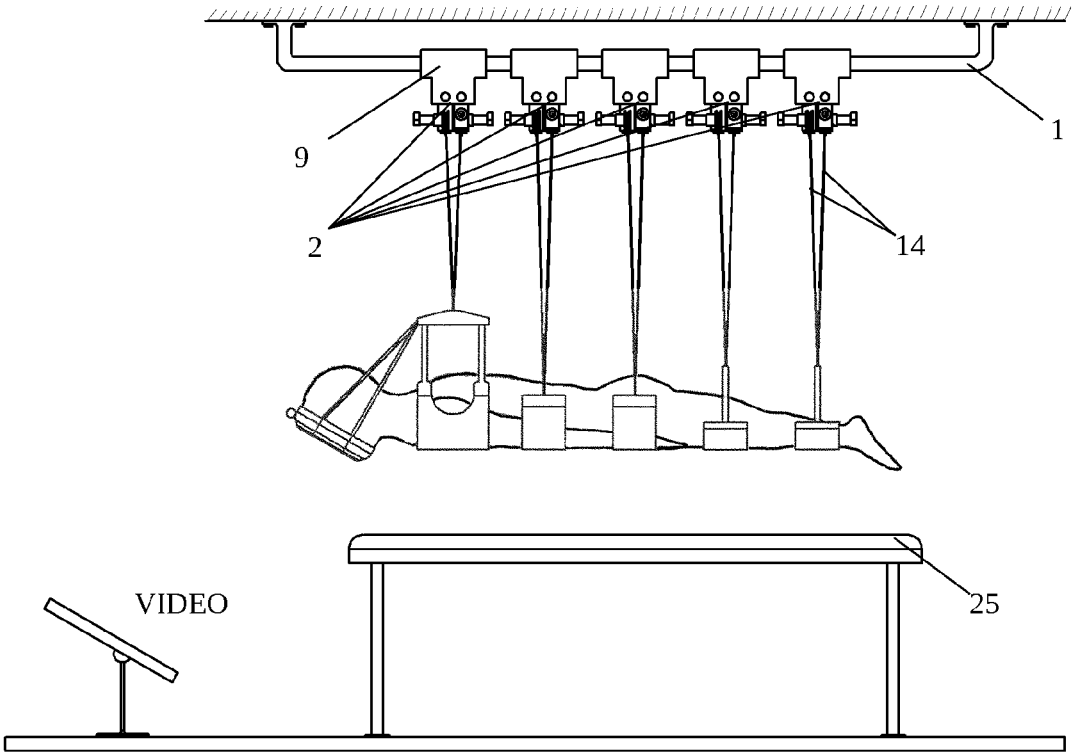

(51) Int. Cl.

| | |
|---|---|
| ***A61H 1/00*** | (2006.01) |
| ***A61H 1/02*** | (2006.01) |
| ***A63B 7/00*** | (2006.01) |
| ***A63B 21/008*** | (2006.01) |
| ***A63B 21/068*** | (2006.01) |
| ***A63B 21/16*** | (2006.01) |
| *A63B 21/00* | (2006.01) |
| *A63B 22/00* | (2006.01) |

(52) U.S. Cl.

CPC ..... *A63B 7/00* (2013.01); *A63B 21/0085* (2013.01); *A63B 21/00178* (2013.01); *A63B 21/00181* (2013.01); *A63B 21/068* (2013.01); *A63B 21/16* (2013.01); *A63B 21/4033* (2015.10); *A63B 21/4043* (2015.10); *A61H 2201/1246* (2013.01); *A61H 2201/1261* (2013.01); *A61H 2201/164* (2013.01); *A61H 2201/1604* (2013.01); *A61H 2201/1614* (2013.01); *A61H 2201/1619* (2013.01); *A61H 2201/1628* (2013.01); *A61H 2201/501* (2013.01); *A61H 2201/5002* (2013.01); *A61H 2201/5035* (2013.01); *A61H 2201/5056* (2013.01); *A61H 2201/5058* (2013.01); *A61H 2201/5069* (2013.01); *A61H 2201/5071* (2013.01); *A61H 2201/5084* (2013.01); *A61H 2203/0468* (2013.01); *A61H 2203/0481* (2013.01); *A63B 21/154* (2013.01); *A63B 21/4003* (2015.10); *A63B 21/4005* (2015.10); *A63B 21/4007* (2015.10); *A63B 21/4009* (2015.10); *A63B 21/4011* (2015.10); *A63B 21/4017* (2015.10); *A63B 2022/0092* (2013.01); *A63B 2022/0094* (2013.01); *A63B 2024/0096* (2013.01); *A63B 2208/0257* (2013.01); *A63B 2208/0261* (2013.01); *A63B 2208/0285* (2013.01); *A63B 2220/16* (2013.01); *A63B 2220/30* (2013.01); *A63B 2220/40* (2013.01); *A63B 2225/20* (2013.01)

(58) Field of Classification Search

CPC .. A61H 1/0237; A61H 1/0274; A61H 1/0292; A61H 2201/00; A61H 2201/0119; A61H 2201/12; A61H 2201/1238; A61H 2201/165; A61H 2201/1652; A61H 2201/1664; A61H 2201/1666; A61H 2201/50; A61H 2201/5005; A61H 2201/5007; A61H 2201/5023; A61H 2201/5043; A61H 2201/5056; A61H 2201/5058; A61H 2201/5064; A61H 2201/5069; A61H 2201/5071; A61H 2203/00; A61H 2203/04; A61H 2203/0443; A61H 2203/0456; A61H 2203/0468; A61H 2203/0481; A63B 21/00; A63B 21/00178; A63B 21/00181; A63B 23/00; A63B 23/02; A63B 23/035; A63B 23/04; A63B 23/12

See application file for complete search history.

(56) References Cited

U.S. PATENT DOCUMENTS

| | | | | |
|---|---|---|---|---|
| 2005/0255971 | A1* | 11/2005 | Solomon | A61H 1/0229 482/54 |
| 2006/0247104 | A1* | 11/2006 | Grabiner | A63B 22/0292 482/54 |
| 2008/0102424 | A1* | 5/2008 | Holljes | A63B 21/4047 434/247 |
| 2010/0144504 | A1* | 6/2010 | Krell | A61H 1/0229 482/143 |
| 2011/0071443 | A1 | 3/2011 | Weisz et al. | |
| 2012/0077163 | A1* | 3/2012 | Sucar Succar | A61H 1/00 434/247 |
| 2013/0059696 | A1* | 3/2013 | Hijmans | A61H 1/0274 482/8 |
| 2013/0116604 | A1* | 5/2013 | Morilla | A61G 7/1015 601/33 |

FOREIGN PATENT DOCUMENTS

| | | |
|---|---|---|
| RU | 2184517 | 7/2002 |
| RU | 2277892 | 6/2006 |
| RU | 2401091 | 10/2010 |

* cited by examiner

THERAPEUTIC EXERCISE METHOD AND THERAPEUTIC EXERCISE APPARATUS

CROSS-REFERENCE TO RELATED APPLICATIONS

This application is a U.S. national stage application of a PCT application PCT/RU2012/000831 filed on 15 Oct. 2012, whose disclosure is incorporated herein in its entirety by reference, which PCT application claims priority of a Russian Federation patent application RU2012100086 filed on 10 Jan. 2012.

FIELD OF THE INVENTION

This invention relates to medicine, including sports medicine, and can be used for rehabilitation of patients with disrupted motor functions due to neurological disorders.

BACKGROUND OF THE INVENTION

One of the first attempts at modelling rhythmic reflexes in infants with a distinct central disruption of motor functions in children was the method developed in 1954 by Tample Fay, an American kinesitherapist. Essentially, this method represented passive modelling of a walking stereotype, carried out by professionals (Glenn Doman, "What to do About your Brain Damage Child", 2007, ISNB 9789984392363, pp. 37-38). Three personnel members worked with the child simultaneously: one of them bending the child's legs and arms on the right side, another one unbending them on the left side, and the third one turning the child's head to the right and to the left. Manipulation of an adult required participation of five personnel members (one person for turning the patient's head, and one person for manipulating each extremity). It is obvious that this method requires much organising.

Progress of kinesitherapy in theory and practice brought about the use of elastic rubber pulls, suspensions with pullies and counterweights, and gliding surfaces to counterbalance the weight of a particular part of the patient's body (V. L. Naidin, "Rehabilitation of Neurosurgical Patients with Motor Deficiencies", Moscow: "Medicine", 1972, pp. 216-217), to enable the patient to do voluntary movements when a small amount of physical force to facilitate that movement. Using physical force, which is less than the weight of the part of the body, these methods can be useful in the training of movements.

One of the drawbacks of the methods available is their high demand on medical personnel, lack of automation and the absence of an easy way to assess their effectiveness.

The feature that is a good indicator of the technical level of the available rehabilitation equipment is the fact that it usually includes some support structures (three-dimension frames, bases, vertical posts) fixed to the floor, a wall or the ceiling, some weights to counterbalance the patient's body, and mechanisms and such assemblies (components) as hydro- or pneumatic pillows to tuck under the patient, with controlled pressure inside the pillow as in the following patent: RU, 2422123, C2, A61H1/00, published on 27 Jun. 2011).

There exists a swimming apparatus (Tza-Pei Grace Chen, Yuichiro Kinoshita Sidney Fels, Ashley Gadd et al., Swimming across the Pacific: A Virtual Swimming Interface Proposal for SIGGRAPH 2004 Emerging Technology), which includes a wooden frame (a shell), upper and lower horizontal beams, static cords dressed over pulleys attached to a beam and fixed with cords and carbines to a suspension of delta-plane kind, used to support the patient's shoulders and hips. Cords dressed over the pulleys mounted on the top beam and over the other pair of pulleys mounted on the lower beam, are provided for every ankle. The cords are attached to sandbags, which act as a counterweight to the swimmer's legs. Balance this apparatus is designed for virtual swimming: the swimmer's body parts are balanced by counterweights.

This apparatus is not very adaptive to different application conditions: a set of counterweights must be assembled and the entire 'client-apparatus' system must be set to a working regime for each individual patient. Also, to make a leg or an arm move, twice as much effort must be applied to overcome the stationary state of a double weight. This design is considerably restricted in its ability to stimulate different parts of the participant's body, because a body can only be rotated around its own axis, and the legs can only move in the vertical plane and only by applying force because there is no drive.

The prototype (closest prior art) of the proposed method and equipment is found in the inventions entitled "A Method and Equipment for Biomechanical Stimulation of Muscles and Rehabilitation of Motor Functions" (RU 2184517, C2, A61H1/00, published on 10 Jul. 2002). This method has the patient's body placed into a home position first: their head, body, legs and arms as well as toes and fingers, then assigns forced movements for these parts with a rehabilitation exercise master program software. The individual patient's maximum allowed values of physiological parameters: heart rate, respiration rate, blood pressure, body temperature are measured a-priori. Then, as forced movements are being carried out, these parameters are continuously measured, and the differences between the measured values and the maximum allowed values are calculated; the calculations are analyzed, producing control signals: 'more', 'less' and/or 'stop the session'.

The equipment in this prototype-invention includes a base and drive and manipulation devices mounted on the base, the drive control device, linked with the drive, a processor, the output of which is linked with the drive via sensors of the patient's physiological parameters, an electric power source and a required-air source, and a system of epv. The actuating devices of the drive are made in the form of blocks of inflatable chambers, linked with one another via the epv system, equipped with electric power and required-air sources, interconnected respectively with the drive control, and sensors of real laws of motion (of the patient's body it seems) and sensors of physiological parameters.

All the known methods, including the prototype-method, have drawbacks typical of all passive apparato-therapies, the most significant of which is insufficient registration of the patient's own activity. Using the parameters listed above, one can judge the patient's state and their psychological comfort quite objectively, but not how effective the rehabilitation process is.

AIMS AND BRIEF SUMMARY OF THE INVENTION

Drawbacks of the known equipment, including the prototype, are: insufficient functional options and adaptability to an individual patient and high power consumption, i.e. insufficiently high consumer properties.

The method of this invention aims at broadening functional options of the method, raising the motivation and effectiveness of rehabilitation of a patient's motor functions, given that the original level was very low or non-existent.

The equipment of this invention aims at broadening its functional options, making it more adaptive to the parameters of an individual person (their height, weight, physique etc), making it more reliable, economical and safe in exploitation, in other words: making it more appealing to clients.

The goal of the method is achieved in the following fashion: the patient is placed horizontally, in the home position, required movements of any part of the patient's body are programmed and executed, using actuating mechanisms, while physiological parameters are monitored, in other words monitoring accompanies the programmed movements, and signals to step up, ease or stop the session are generated; after the patient has been placed in the home position, he/she is lifted and held suspended in the state of indifferent equilibrium, enabling the operator to generate complex, interrelated, rhythmic programmed movements of any part of the body, consuming a minimal amount of energy; the patient is held suspended with the use of suspensions positioned appropriately for different parts of the patient's body, carrying programmed actuating mechanisms that can be used simultaneously and independently of each other, each of them with its own combined electric and pneumatic drive; actual parameters of the programmed movements and power consumption of the drives of the actuating mechanisms are measured and recorded during programmed movements in the course of every session; effectiveness of each session is measured on the basis of power consumption dynamics; in the case when the patient initiates or continues his/her own physical activity during the session, which is detected by decreased energy consumption rate of the particular drive of the particular actuation mechanism, programmed movements are corrected; a virtual role-play environment generated on a PC is used to motivate the patient's participation in the procedure, and the patient is able to control a virtual object; every parameter of the programmed movements generated during the session, is stored for analysis of how effective the session was and comparing it with data of other rehabilitation exercise sessions.

The goal of the invention in its equipment part is achieved as follows: the proposed apparatus includes a base with actuating mechanisms mounted on it, devices to fasten them to different parts of the patient's body, a control and monitoring block, a pc with a master program, the outputs of which are connected with the actuation mechanisms via the control block, an electric power and a compressed air sources; the base consists of two parallel longitudinal guides, fastened to a firm and stationary base above the patient; traverses can slide along the guides; each traverse carries actuating mechanisms, each representing an assembly made up of a pneumatic cylinder with a plunger, an electric motor with an encoder (a rotation angle sensor) and a pulley on the output shaft; the actuating member in the form of—for example—a monofilament or a flexible non-extendable cord with a smooth polymer coating; this member passes through the butt-end seal of the pneumatic cylinder, while one of its ends is connected with the plunger, its middle part fits the groove of the pulley of the electric motor, while its second end of the actuating member can be connected to the suspension supporting a particular part of the patient's body; the control block of each actuating mechanism includes a controller, a current sensor, an encoder and an electrically controlled pneumatic distributor; the working space of each pneumatic cylinder is linked with a pressure sensor and—via the electrically driven pneumatic distributor—with the compressed air source; the output of every sensor of the control block is connected with the input of the controller, one output of which is connected—via the current sensor—with the electric motor, while the other output is connected with the electrically driven pneumatic distributor; in addition, each pneumatic cylinder can be equipped with a receiver, the inner space of which connects with the working space of the pneumatic cylinder via an orifice in the wall of the cylinder.

The lack of any information, of technical solutions with an identical (or equivalent) set of essential, including distinguishing, features together with the same characteristics in generally available sources, including patents, characterize the proposed method and technical equipment as new and not obvious, which, given that this invention definitely achieves the required results that should qualify the invention as patentable.

BRIEF DESCRIPTION OF DRAWINGS OF THE INVENTION

Figure 2:
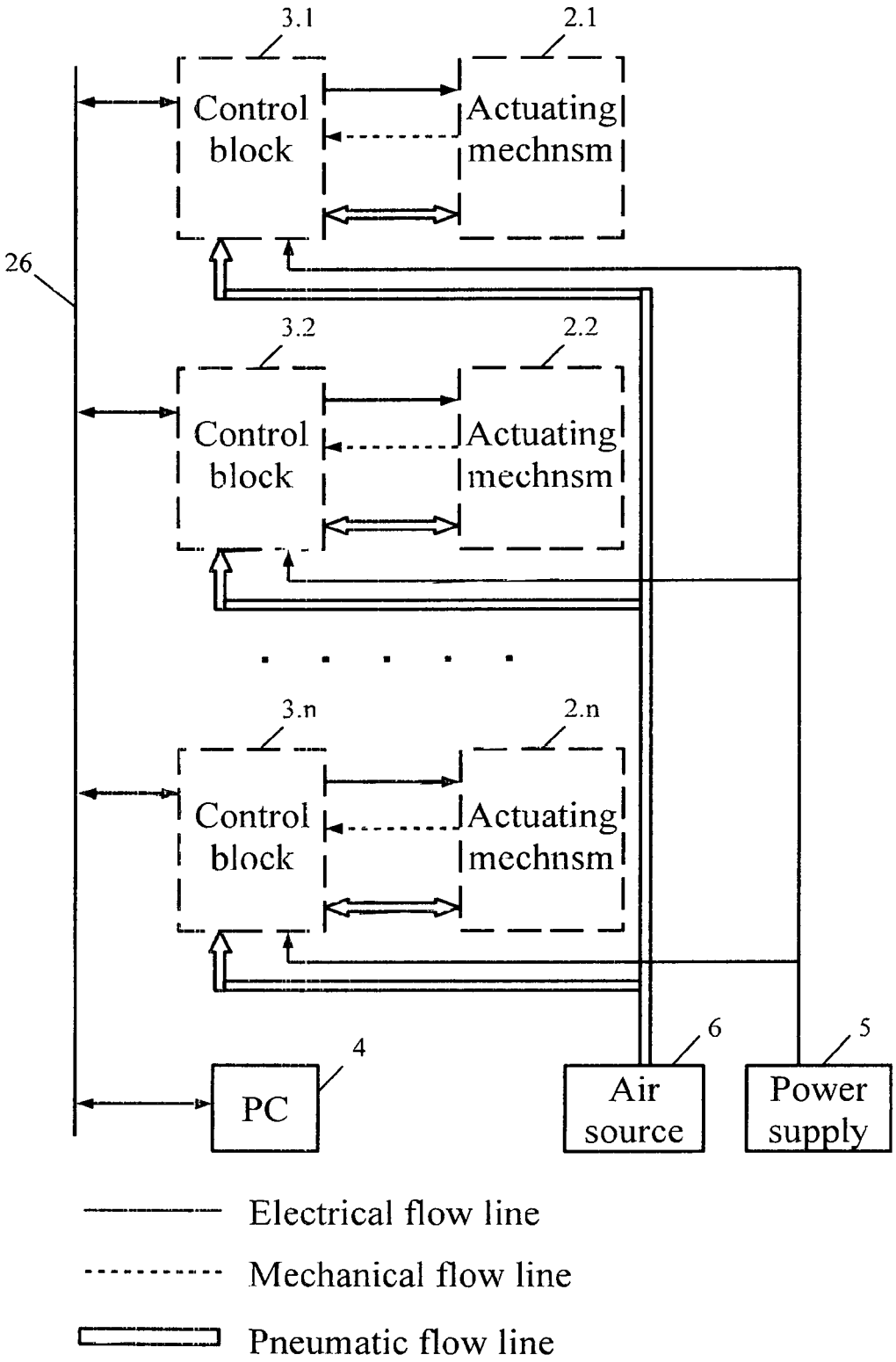
Figure 3:
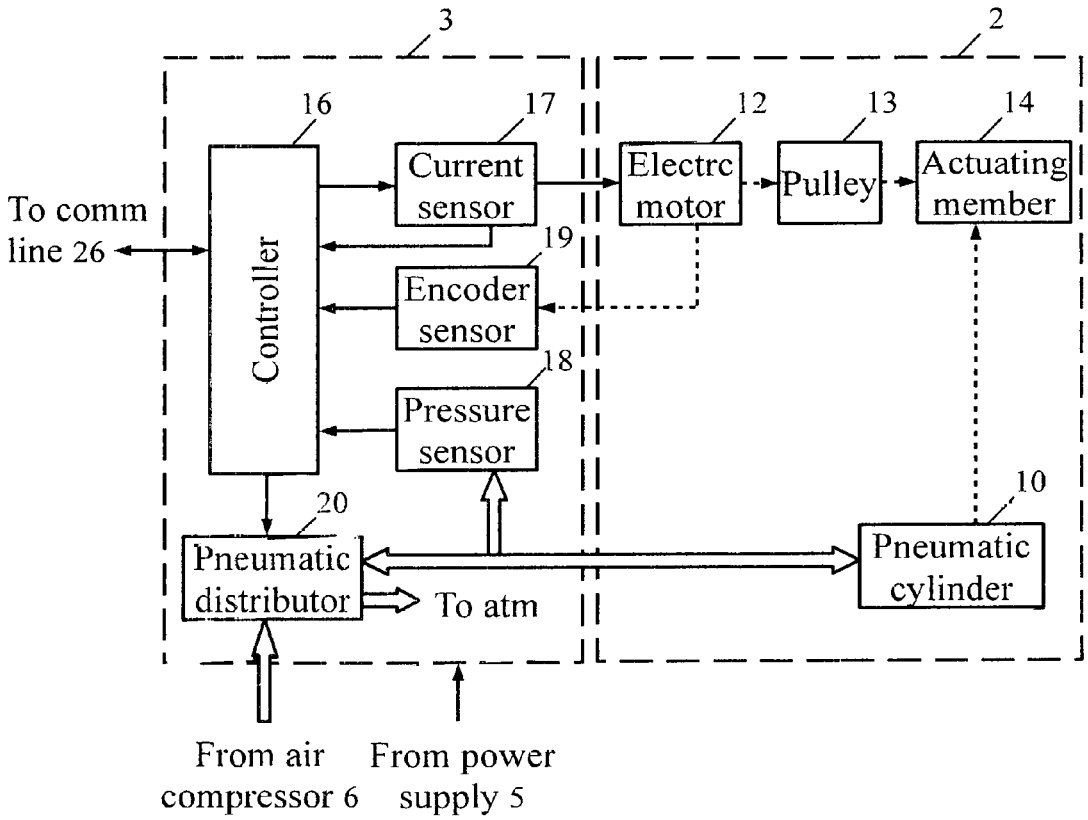
Figure 4:
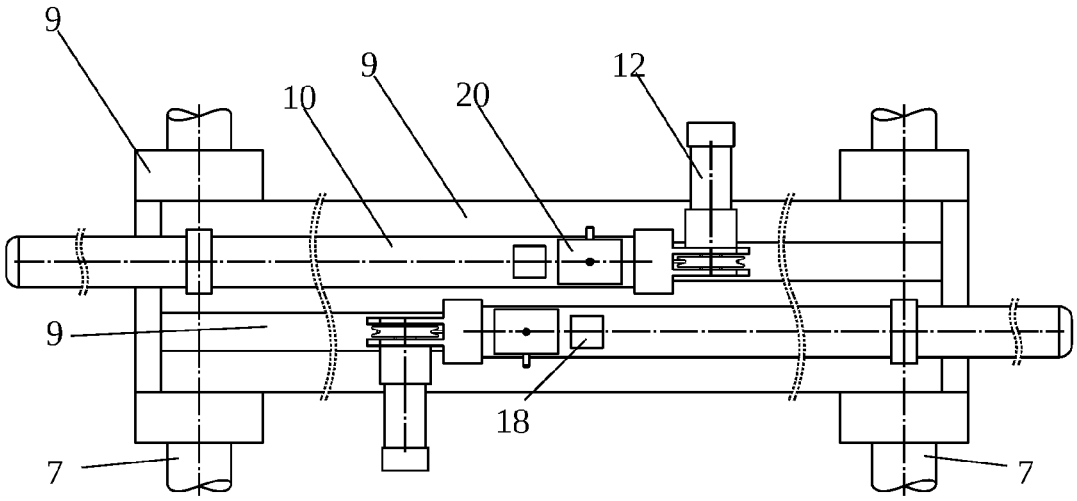
Figure 5:
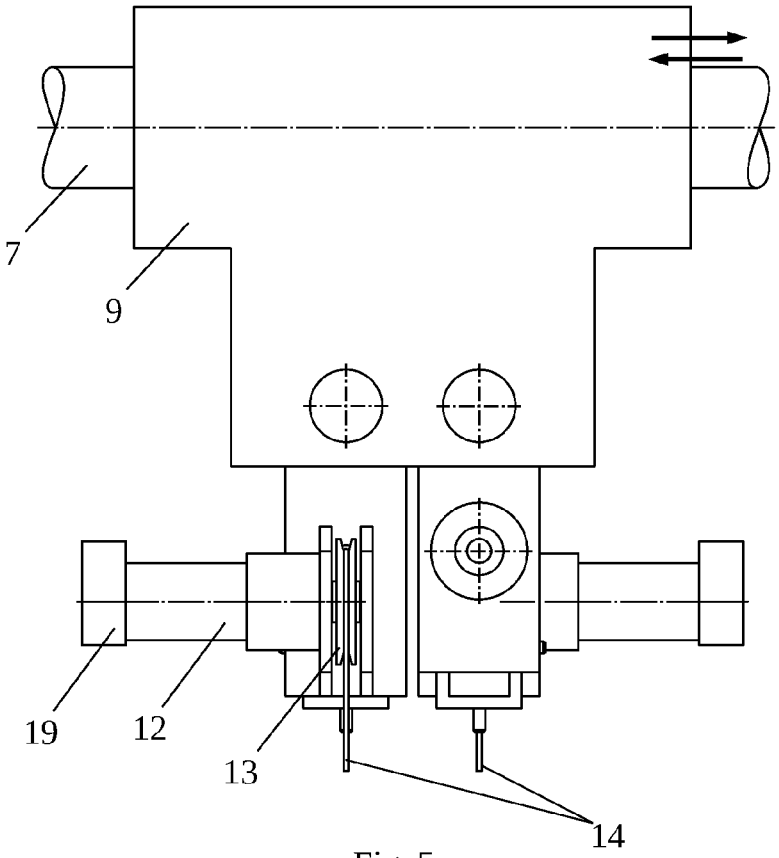
Figure 6:
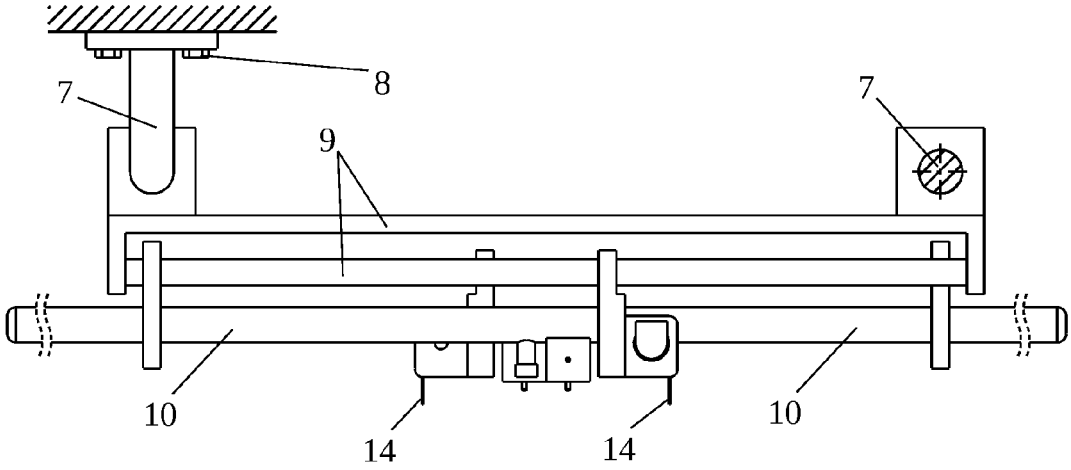
Figure 7:
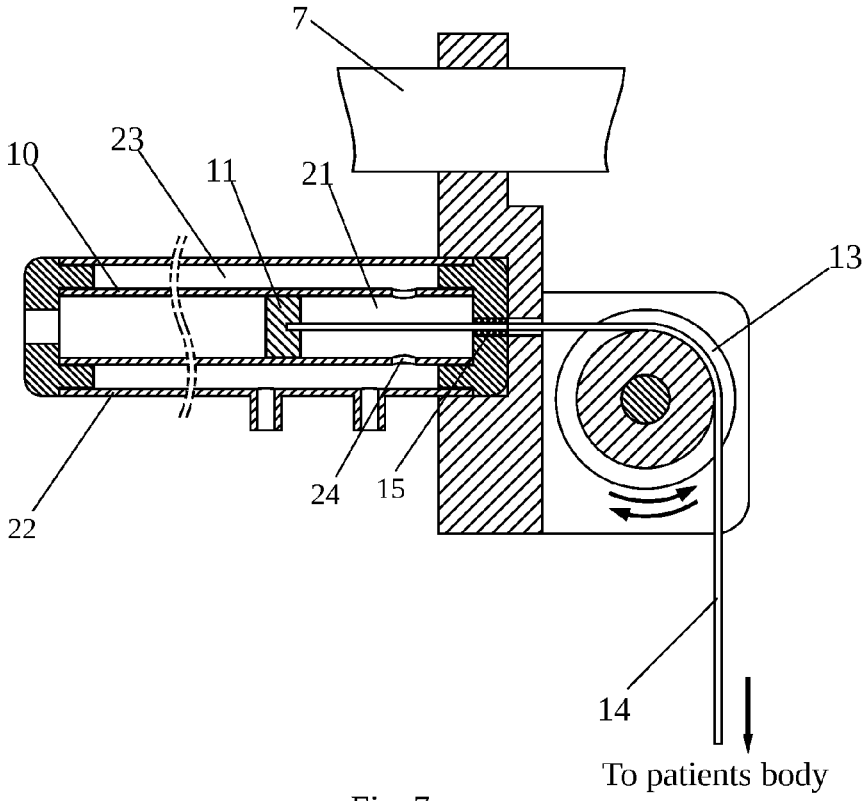

The structure of the inventive technical equipment is illustrated with graphic materials, which include the following views:

a general view of the inventive apparatus (FIG. 1);

a block-diagram (FIG. 2) of the inventive apparatus;

a block-diagram of one of the actuating mechanisms of the inventive apparatus with a control block (FIG. 3);

a traverse with two actuating mechanisms and sensors (FIG. 4, view from below);

a traverse with two actuating mechanisms and sensors (FIG. 5, a side view);

a traverse with two actuating mechanisms and sensors (FIG. 6, a frontal view); and a fragment of an actuating mechanism (FIG. 7, a section along the central line of the pneumatic cylinder).

DETAIL DESCRIPTION OF PREFERRED EMBODIMENTS OF THE INVENTION

The proposed rehabilitation exercise apparatus (FIGS. 1-7) includes a base 1, consisting of two parallel longitudinal guides 7 with fasteners 8 for attaching the guides to the ceiling; movable traverses 9 capable of sliding along the guides, (for example, the number of the traverses 9 is five, as shown in FIG. 1), i.e. the number of the traverses fits to the parts of the patient's body that require to be suspended. Each of the movable traverses 9 carries a pair of actuating mechanisms 2. Each of the actuating mechanisms 2 is used for holding the patient suspended and manipulating a particular part of his/her body; each actuating mechanism includes a pneumatic cylinder 10 with an actuating member 14 and equipped with an electric motor 12 with a pulley 13 on the output shaft. The electric motor 12 can be equipped with a reducer (as shown in FIGS. 4-6). The actuating member 14 of the actuating mechanism 2 is executed as a flexible non-extendable cord with a smooth polymer coating (or it represents a thick polymer monofilament); its one end is connected with a plunger 11 of the pneumatic cylinder 10, it passes through a butt-end seal 15 of the pneumatic cylinder 10, its middle part fits into the groove of the pulley 13, while its other end is connected to a suspension supporting the patient (the suspensions are shown in FIG. 1, but individual suspensions are not indicated with numbers).

A control block 3 of each actuating mechanism 2 includes a controller 16, a pressure sensor 18, pneumatically connected with a working space 21 of the cylinder 10, an encoder 19 (rotation angle sensor), mounted on the shaft of the electric motor 12, a current sensor 17 detecting a reduction in energy consumption by the electric motor, by measuring electric current in electric feeding lines of the electric motor and electrically driven pneumatic distributor 20. The control blocks 3 are powered from a power supply 5. The working space 21 of each pneumatic cylinder 10 is connected, via the electrically driven (three-position, normally shut) pneumatic distributor 20, with a compressed air source 6. The outputs of all sensors of the control block 3 (the pressure sensor 18, the encoder 18, and the current sensor 17) are electrically connected with the controller 16. Each controller 16 of each control block 3 (see positions **3.1-3.*n*, FIGS. 2 and 3) is connected to a computer 4 pre-programmed with appropriate software loaded via a data transfer network 26**.

Each pneumatic cylinder 10 of each actuating mechanism (positions **2.1-2.*n*, FIG. 2) can be additionally provided with a receiver 22 in the form of a casing (FIG. 7), forming a cavity 23 between the receiver 22 and pneumatic cylinder 10, and the cavity 23 of the receiver 22 connects with the working space 21 of the pneumatic cylinder 10 via an orifice 24 in the wall of the pneumatic cylinder 10. The apparatus also includes a position sensor of the position of the patient's body when he/she controls a virtual object on the computer's display. A common sensor-accelerometer can be used for this purpose. A lodgement 25** with a soft, changeable cover is placed under the apparatus for the patient's home position.

The proposed rehabilitation method uses the proposed apparatus as follows. The patient is placed horizontally on the lodgement 25, either face up or face down. The suspension components are placed in appropriate positions on the lodgement a-priori (they may be executed as a cuff with a Velcro clasp and a ring for the carabine latch of the actuating member 14), which are attached on the patient's body in accordance with the zones that require support. Moving the traverses 9 along the longitudinal guides 7 and moving the actuating mechanisms 2 along the traverses 9, distances between the actuating mechanisms are set so that the mutual position of the actuating mechanisms would correspond to the patient's anthropometric data.

The computer 4 preprogrammed with appropriate software controls the electrically driven pneumatic distributors 20 via the data transfer network 26 and, via each controller 16 of each control block **3.1-3.*n***, (which connections are reflected on FIG.) supplies the appropriate quantity of air to each pneumatic cylinder in such a fashion as to bring the 'apparatus-patient' system into a working position, which means that the patient is lifted to an assigned height and rests above the lodgement, supported in the state of practically indifferent equilibrium.

The following parameters are monitored: a) pressure distribution in the pneumatic cylinders 10, using the pressure sensors 18; b) the height to which the actuating mechanisms lift each part of the body in accordance with the program, via the encoders-sensors 19. Once the patient has been lifted, i.e. the equilibrium state of the 'apparatus-patient' system has been reached, the system acquires the following features: mechanical deviations cause the system to gently tend back, to its original median position, every actuating member 14 and consequently every suspension component is easily moved both vertically and horizontally, only a minor effort is required to set any part of the patient's body or the entire body into motion because any travel of the plunger 11 in the pneumatic cylinder 10 with the receiver 22 and, consequently, any travel of the respective suspension in a vertical direction causes only a slight change of pressure, and the effort required to move the plunger from the median position downwards or upwards is virtually the same.

For example: given the plunger in the working model has travelled 10 cm and the weight suspended from the actuating member 14 is 10 kg, pressure in the pneumatic cylinder changes by 0.027 kg/cm2 and the effort required to maintain the weight in that inclined position equals approximately 1H. Then the pulleys 13 of the electric motors 12, when signaled by the controllers 16, move in reciprocating rotary fashion (see the arrows in FIG. 7) as required by the program, which has the amplitude of angular oscillations, their frequency and—for different parts of the body—their individual movement phases set, and every pulley and consequently every suspension can move according to the harmonic law (along a sinusoid). For example: motion begins at the head-chest section and is directed downwards, then, after a certain period of time, the pelvis starts moving in the same direction, then, after another period of time, the hips, then the shin move in the same direction.

Then, when the lowest point of motion is reached, all parts of the body start moving upwards following the same order. Since all the parts of the body move with the same frequency, the phase difference between them is maintained, and the entire body oscillates along an assigned path, wavelike, imitating dolphin's motions for example. The amplitude and phase of the oscillation can be adjusted for any part of the body individually, and the common oscillation for all parts of the body can be controlled during the operation. Carrying out the programmed movements with assigned parameters provides the patient with the option to participate in the movements together i.e. 'in unison' with the electric motors of the actuating mechanisms, and the parameters of the movements will be controlled by amperage of the current supplied to the motor as well as on the physical effort applied by the patient, and the amperage is controlled and can be increased or decreased.

The computer also controls the virtual role-play environment, displaying it on the monitor set in a position comfortable for the patient. The patient controls the play (virtual) object via the position sensors, which follow the patient's movements and send signals to the computer; consequently, the patient can move the play object vertically or horizontally. Movements of the patient's legs are monitored by encoder sensors, and such parameters as amplitude and frequency of the legs' movements are transferred to the computer 4, and the computer controls velocity of the play object on the basis of these signals; in other words the patient can move the play object forward, changing its velocity, directly correlated with the quantitative values of the amplitude and/or frequency of the legs. When such movement parameters as amplitude and frequency are strictly assigned, velocity of the virtual object can be controlled by the patient's physical activity, i.e. on the patient's self-sufficiency within the limits of the programmed movement, and these limits are determined, using electric current sensors 17, which measure a decrease in energy consumption by the electric motors 12, which increases the virtual object's movement velocity in the game. The patient is practically involved into the game, which provides the patient with a strong motivation to participate in the rehabilitation process. All the parameters recorded during the session can be stored to analyze the efficiency of the session and to compare its data with data of other rehabilitation exercise sessions.

The proposed invention allows achieving the requisite result while running a rehabilitation session in the range of situations from the patient being completely passive to partially or completely disconnected stimuli, i.e. it works as a training stimulator.

The invention claimed is:

1. An apparatus adapted for rehabilitation exercises of a patient's body, comprising:

a stationary base (1) including a plurality of parallel longitudinal guides (7);

a plurality of traverses (9) slidably mounted along the guides (7);

a pair of actuating mechanisms (2) lifting the patient's body and maintaining a state of indifferent equilibrium of the patient's body; said pair of actuating mechanisms (2) are mounted on each traverse (9) of said plurality of traverses (9) and adapted for suspending and manipulating parts of the patient's body; each actuating mechanism (2) of said pair of actuating mechanisms (2) includes:

a pneumatic cylinder (10) further including: a plunger (11) slidably mounted therein, and a butt-end seal (15) sealing an end of said pneumatic cylinder (10);

an electric motor (12) essentially driving the pneumatic cylinder (10); said electric motor (12) is electrically powered through electric wires, and said electric motor (12) is immovably attached to a rotatable output shaft;

a pulley (13) immovably mounted on said output shaft, said pulley (13) has a groove peripherally formed thereon; and a flexible non-extendable actuating member (14) having a first end attached to the plunger (11), and a second end connected to a suspension component adapted for essentially supporting a part of the patient's body; whereas the actuating member (14) passes through the butt-end seal (15) and through said groove, thereby enabling the part of the patient's body to be lifted to an assigned height.

2. The apparatus according to claim 1, further comprising:

a compressed air source (6);

a pre-programmed computer (4);

a plurality of control blocks (3), wherein each control block (3) of the plurality of control blocks (3) is electrically, pneumatically and mechanically connected to the actuation mechanism (2) of said pair of actuating mechanisms (2), wherein said pre-programmed computer (4) controls said pair of actuating mechanisms (2) essentially by sending control signals from each said control block (3) of the plurality of control blocks (3) electrically connected to the electric motor (12) of each said actuation mechanism (2) of said pair of actuating mechanisms (2); each said control block (3) further includes:

a controller (16) having at least a first output, a second output, a first input, a second input, and a third input;

an electric current sensor (17) measuring electric current in said electric wires and having an output connected to the first input of said controller (16);

a pressure sensor (18) measuring air pressure in the pneumatic cylinder (10) and having an output connected to the second input of said controller (16);

an encoder (19) mounted to said output shaft, essentially measuring said height of lifting of the part of the patient's body suspended by the actuating mechanism (2), and having an output connected to the third input of said controller (16);

an electrically driven pneumatic distributor (20) pneumatically communicating with the compressed air source (6); said distributor (20) is electrically connected with the first output of said controller (16);

wherein:

said pneumatic cylinder (10) further includes: a working space (21) pneumatically communicating with the pressure sensor (18) and with the pneumatic distributor (20); and the second output of said controller (16) is electrically connected to said electric motor (12) via said electric current sensor (17).

3. The apparatus according to claim 2, wherein:

each said pneumatic cylinder (10) has sidewalls; and each said actuating mechanism (2) of said pair of actuating mechanisms (2) further includes:

a receiver (22) encapsulating said pneumatic cylinder (10); said receiver (22) includes a cavity (23), external to said pneumatic cylinder (10), and said cavity (23) is pneumatically connected with the working space (21) via an orifice (24) made in said sidewalls.

4. A method adapted for rehabilitation exercises of a patient's body, comprising the steps of:

providing an apparatus according to claim 2;

starting a rehabilitation session by placing the patient's body in a horizontal home position and fastening the actuating mechanisms (2) of said pair of actuating mechanisms (2) to corresponding parts of the patient's body, wherein the corresponding parts of the patient's body are suspended using the actuating mechanisms (2) of said pair of actuating mechanisms (2); the actuating mechanisms (2) of said pair of actuating mechanisms (2) each functions simultaneously and independently by interacting with the electric motor (12) being part of the actuating mechanism (2) of said pair of actuating mechanisms (2), and with the pneumatic cylinder (10) being part of the actuating mechanism (2) of said pair of actuating mechanisms (2) and controlled essentially by the pre-programmed computer (4);

setting predetermined programmed movements by predeterminedly programming the computer (4) and applying the programmed movements to the patient's body essentially via the actuating mechanisms (2) of said pair of actuating mechanisms (2);

controlling physiological parameters of the patient's body during the rehabilitation session and using the physiological parameters for generating signals to control the programmed movements, either by amplifying or reducing an intenseness of the programmed movements, or disconnecting at least one of the actuating mechanisms (2) of said pair of actuating mechanisms (2), or interrupting the rehabilitation session;

by predeterminedly programming the computer (4), lifting the patient's body by the actuating mechanisms (2) of said pair of actuating mechanisms (2) and maintaining the patient's body in a state of indifferent equilibrium in order to provide the programmed movements to corresponding parts of the patient's body;

measuring factual parameters of the programmed movements and electric power consumption of the electric motors (12);

recording the programmed movements each during every said rehabilitation session;

measuring physical activities of the patient's body during each said rehabilitation session on a basis of power consumption dynamics;

correcting the factual parameters of the programmed movements, when the patient starts or continues showing physical activity during said rehabilitation session, indicated by a decreased power consumption of the electric motor (12) of the actuating mechanism (2) of said pair of actuating mechanisms (2);

arranging a virtual game environment and a virtual object by predeterminedly programming the computer (4) to motivate the patient's participation in the rehabilitation exercise, wherein the patient is able to control the virtual object; and recording the factual parameters of the programmed movements during any of said rehabilitation session and storing thereof to facilitate analysis of an effectiveness of the session and compare the factual parameters of the session with the factual parameters of another said rehabilitation session.

* * * * *